US008182309B2

(12) United States Patent
Norman

(10) Patent No.: US 8,182,309 B2
(45) Date of Patent: May 22, 2012

(54) TOY WITH INTERCHANGEABLE PARTS

(75) Inventor: Casey W. Norman, Andoversford (GB)

(73) Assignee: Genie Toys, plc. (GB)

( * ) Notice: Subject to any disclaimer, the term of this patent is extended or adjusted under 35 U.S.C. 154(b) by 398 days.

(21) Appl. No.: 12/243,993

(22) Filed: Oct. 2, 2008

(65) Prior Publication Data

US 2010/0087120 A1 Apr. 8, 2010

(51) Int. Cl.
*A63H 3/16* (2006.01)

(52) U.S. Cl. ..... 446/297

(58) Field of Classification Search ..... 446/297, 446/308–310, 901, 71, 75–76, 124–125
See application file for complete search history.

(56) References Cited

U.S. PATENT DOCUMENTS

| | | | | |
|---|---|---|---|---|
| 3,610,510 | A | 10/1971 | Lowry | |
| D296,762 | S | 7/1988 | Sato | |
| 4,836,823 | A | 6/1989 | Laven | |
| 4,950,200 | A | 8/1990 | Curran | |
| 5,607,336 | A | 3/1997 | Lebensfeld et al. | |
| 5,609,508 | A | 3/1997 | Wingate | |
| 5,682,999 | A | 11/1997 | Larson | |
| D389,855 | S | 1/1998 | Druz | |
| 5,944,577 | A | 8/1999 | Yanofsky et al. | |
| 5,957,747 | A | 9/1999 | Liggitt | |
| 6,050,695 | A | 4/2000 | Fromm | |
| 6,439,947 | B1 | 8/2002 | Lehavi | |
| D470,612 | S | 2/2003 | Kit | |
| 6,692,330 | B1 | 2/2004 | Kulick | |
| 7,018,213 | B2 * | 3/2006 | Marcus et al. | 434/322 |
| D523,757 | S | 6/2006 | Garcia et al. | |
| 7,291,052 | B2 * | 11/2007 | Ellman et al. | 446/100 |
| 7,306,504 | B2 * | 12/2007 | Saucier | 446/487 |
| 2006/0228983 | A1 | 10/2006 | Carthern | |
| 2007/0031809 | A1 | 2/2007 | Wei | |

FOREIGN PATENT DOCUMENTS

| | | |
|---|---|---|
| EP | 1 616 609 | 1/2006 |
| WO | 93/03807 | 3/1993 |

OTHER PUBLICATIONS

Worry Box, Three Guardian Angels (www.strapya-world.com).

* cited by examiner

*Primary Examiner* — Gene Kim
*Assistant Examiner* — Amir Klayman
(74) *Attorney, Agent, or Firm* — DLA Piper LLP (US)

(57) ABSTRACT

A toy with interchangeable parts is provided. The toy is comprised of a plurality of first and second enclosures that each contain unique indicia and are attachable and detachable. In one form, the enclosures are each one-half of a first toy form, such as a heart. An enclosure from the plurality of first enclosures attaches to an enclosure of the plurality of second enclosures to form the first toy form. The enclosures separate to form a second toy form. In the second form, the enclosures can further open to expose an inner cavity of the enclosures, which, in one form, contains a figurine. First and second enclosures are interchangeable such that different toys of the first toy form may be created. In one form, the first toy form is adapted to interact with a docking station that plays sounds corresponding to the first toy form.

16 Claims, 4 Drawing Sheets

TOY WITH INTERCHANGEABLE PARTS

TECHNICAL FIELD

This disclosure relates to toys. In particular, it relates to toys having attachable, detachable and interchangeable enclosures, which each conceal a figurine that becomes exposed upon opening the individual enclosures.

BACKGROUND

Toys with interchangeable parts are in demand because they allow the user to create, in effect, many different toys from one or a few pieces. Interactive toys, such as toys with audio or video, are also in demand because they keep the user's interest. Toys with parts that can be collected are also in demand because users enjoy trading the collectable items and trying to collect every toy or part in a set. Toys that conceal other toys are in demand because they are, in essence, multiple toys in one toy and they surprise and delight users. There is an increasing demand for toys that combine all or some of the above features as well as possibly additional features.

SUMMARY

We provide toys comprising attachable and detachable enclosures that are one-half of a first toy form, such as one-half of a heart. The enclosures are attachable to form the first toy form; the example, the complete heart. An enclosure may have a matching enclosure such that those two enclosures form a set. An enclosure from one set may be interchangeable with enclosures from another set, in effect, forming a new toy; i.e., a different heart. When two enclosures are detached from each other they form a second toy form. In the second toy form, each enclosure may be opened exposing an item, for example a figurine, within creating even more toys.

In particular, the toy may comprise at least two enclosures each being defined by at least two enclosure portions, wherein the enclosure portions are adapted to attach to each other and to separate from each other, and at least one figurine in at least one of the enclosures, wherein the at least two enclosures are adapted to attach to each others, forming a first toy form, and to separate from each other, forming a second toy form.

The toy may also comprises a plurality of first enclosures and a plurality of second enclosures, at least one figurine in the first enclosures and at least one figurine in the second enclosures, wherein the first enclosures are adapted to attach only to the second enclosures and the second enclosures are adapted to attach only to the first enclosures, and wherein when a first enclosure and a second enclosure are attached, they form a first toy form and when the first enclosure the second enclosure detach, they form a second toy form.

The toy may also comprise a plurality of first enclosures and a plurality of second enclosures adapted to attach to each other to form a first toy form, and to separate from each other to form a second toy form, at least one figurine in the first enclosures and at least one figurine in the second enclosures, a docking station comprising a speaker, an audio generating circuit having a speech synthesizer, a memory component and an amplifier, a power source coupled to the docking station and the enclosure, a memory storing a plurality of phrases and an electrical contact compatible with the audio generating circuit such that the docking station produces a plurality of phrases when the docking station is connected to the toy in a first toy form, and wherein the first enclosures are adapted to attach only to the second enclosures and the second enclosures are adapted to attach only to the first enclosures.

BRIEF DESCRIPTION OF THE DRAWINGS

For the purpose of illustration, there is shown in the drawings forms which are presently preferred. It should be understood that the forms are not limited to the precise arrangements and instrumentalities shown.

DETAILED DESCRIPTION OF THE DRAWINGS

Figure 1A:
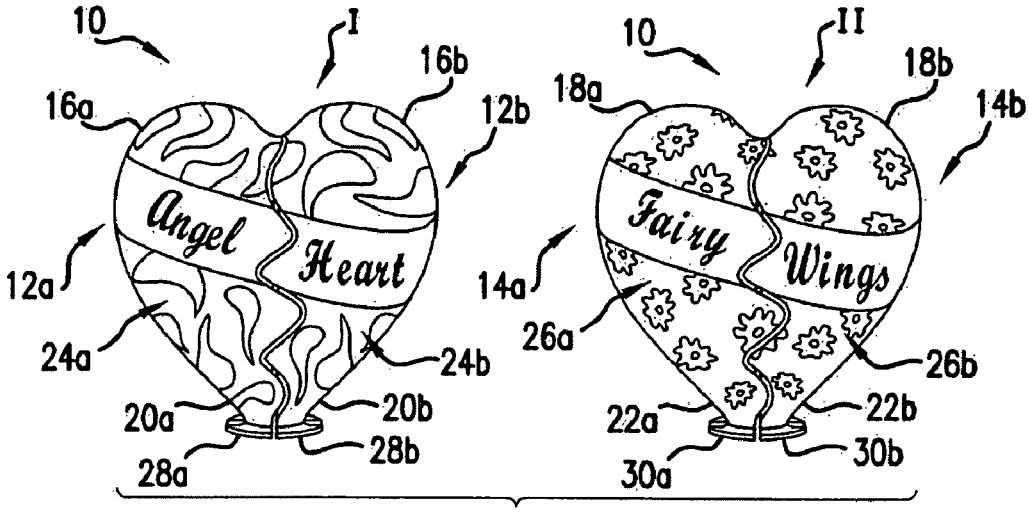
FIG. 1A is a perspective view of two different sets of toys, each in a first toy form.

It will be appreciated that the following description is intended to refer to specific examples of structure selected for illustration in the drawings and is not intended to define or limit the disclosure, other than in the appended claims.

FIG. 1A shows two toys 10. Each toy is comprised of a matching set of enclosures 12*a* and 12*b* and 14*a* and 14*b*, respectively. FIG. 1A shows that enclosures 12*a* and 12*b* comprise a first set, designated as I and enclosures 14*a* and 14*b* comprise a second set, designated as II. FIG. 1A shows these matching sets of enclosures attached to one another. As described in more detail below, when the enclosures are attached, they form a first toy form.

Figure 1B:
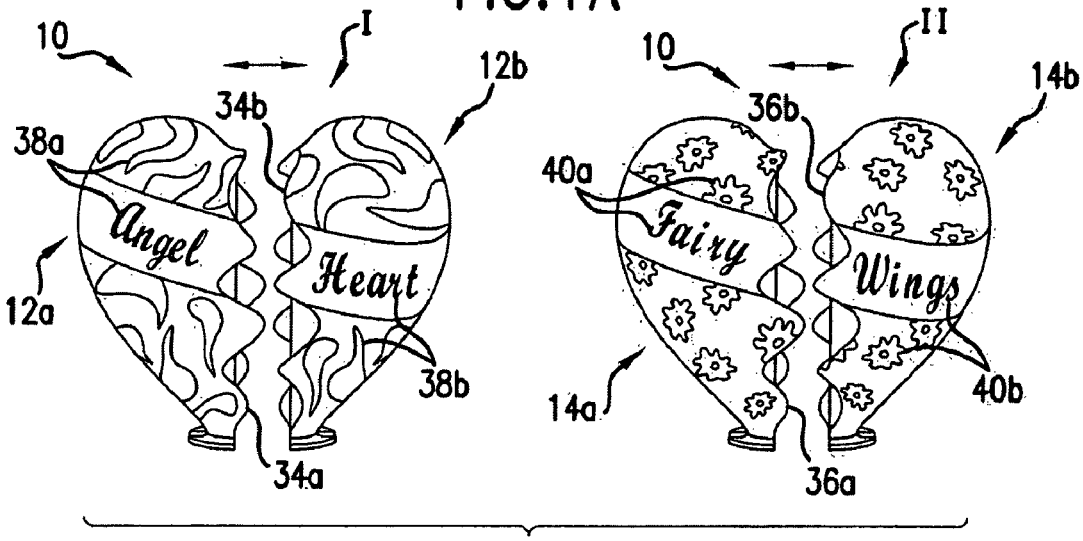
FIG. 1B is a perspective view of the set of toys shown in FIG. 1A in a second toy form.

As provided above, the first set I is comprised of a first enclosure 12*a* and a "matching" second enclosure 12*b*. Likewise, the second set II is comprised of a first enclosure 14*a* and a "matching" second enclosure 14*b*. As shown in FIG. 1B, the first enclosure 12*a* has indicia 38*a*, the second enclosure 12*b* has indicia 38*b*, first enclosure 14*a* has indicia 40*a* and second enclosure 14*b* has indicia 40*b*. The first enclosure 12*a* of the first set I is substantially similar to the first enclosures 14*a* of the second set II. The second enclosure 12*b* of the first set I is substantially similar to the second enclosure 14*b* of the second set II. In particular, the enclosures differ only in their respective indicia. This indicia may be colors, designs, words, protrusions, indentations, etc. As shown in FIG. 1B, some indicia 38*a* and 38*b* match, in particular, the design indicia of each enclosure matches while the word indicia are different. Similarly, indicia 40*a* and 40*b* match, in particular, the design indicia of each enclosure matches while the word indicia are different. By "matching," it is meant that the indicia are substantially identical except that they have different words. As shown in FIG. 1A, when the enclosures are attached (i.e., in the first form) the word indicia form phrases. For example, the first matching set forms the phrase "Angel Heart." The second matching set forms the phrase, "Fairy Wings."

As shown in FIG. 1A, there may be a set or a plurality of first enclosures 12*a* and 14*a* and a set or plurality of second enclosures 12*b* and 14*b*. For example, the first enclosure 12*a* of the first set I and the first enclosure 14*b* of the second set II comprise a set or plurality of first enclosures. The second enclosure 12*b* of the first set I and the second enclosure 14*b* of the second set II comprise a set or plurality of second enclosures. As shown in FIG. 1A, each first enclosure 12*a*, 14*a* has a matching second enclosure 12*b*, 14*b*, respectively. As shown in FIG. 1A and as provided above, the first enclosure 12*a* and second enclosure 12*b* in the first set I may both be the same color and have the same design but have different but complementary words. By complementary, it is meant that the indicia form an intelligible phrase.

Figure 1C:
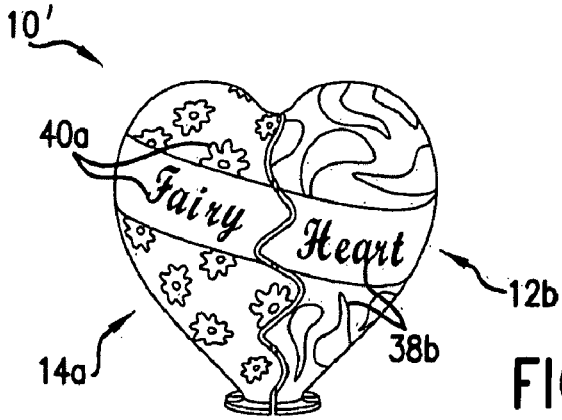
FIG. 1C is a perspective view of a enclosure of one set of a toy shown in FIG. 1A and 1B matched with an enclosure of another set of a toy shown in FIGS. 1A and 1B.

Among many various sets, every first enclosure may be attachable to every second enclosure regardless of whether that first enclosure and second enclosure have identical indicia. In this regard, it is preferable that any first enclosure can form a complementary phrase with any second enclosure. As shown in FIG. 1B, the first enclosure 12*a* of the first set I may be separated from the second enclosure 12*b* of the first set I. Similarly, the first enclosure 14*a* of the second set II may be separated from the second enclosure 14*b* of the second set II. As shown in FIG. 1C, the first enclosure 14*a* of the second set may then be attached to the second enclosure 12*b* of the first set, thus, forming a new toy. This forms the phrase, "Fairy Heart." Similarly, the first enclosure 12*a* of the first, set I could be attached to the second enclosure 14*b* of the second set II to form another second toy form with a different phrase.

Among many various sets, first enclosures may or may not be attachable to other first enclosures. Similarly, second enclosures may or may not be attachable to any other second enclosures. As shown in FIG. 1A-1C the first enclosure 12*a* of the first set I has the same undulating pattern 34*a* as the undulating pattern 36*a* of the first enclosure 14*a* of the second set II. As described below, these respective undulating patterns 34*a*, 36*a* would not match-up to allow the two shown first enclosures 12*a*, 14*a* to be attached unless one of the first enclosures was reversed or "flipped over". If one of the first enclosures, either 12*a* or 14*a*, is flipped over, the first enclosures can fit together although the rear portion or face of one of the first enclosures will now face the same direction as the front face of the other first enclosure. The same holds true with respect to the second enclosures. Thus, the rear portions or faces of each enclosure should include indicia. This indicia may match another enclosure in the set and have words that form intelligible phrases with other first enclosures or second enclosures.

As provided above, FIG. 1B shows the first enclosure 12*a* of the first set I separated from the second enclosure 12*b* of the first set I and the first enclosure 14*a* of the second set II separated from the second enclosure 14*b* of the second set II. Thus, both toys are in the second toy form. The first enclosures 12*a*, 14*a* are separated from the second enclosures 12*b*, 14*b*, respectively, by being completely detached therefrom. However, the first enclosures may be attached to their respective second enclosures by a hinge whereby they are separated by being swung away from each other; i.e., opened. "Separated" or "detached" as used herein with respect to the relative position of the first and second enclosures refers to any position in which the first enclosure and the second enclosure can be further opened, separated or detached, as explained below.

FIG. 1B shows that each of the respective enclosures 12*a*, 12*b*, 14*a*, 14*b* is in the shape of one-half of a heart. The enclosures may be other shapes such as a cube, pyramid, oval, prism, or one half of any of the aforementioned shapes. For example, the enclosures may each be one-half of an action figure such as a robot. Or, each one-half of the action figure or robot's head. In this form, the head may conceal a robot-skeleton figurine the first toy form or where a first portion and second portion are attached. When the head is opened, it reveals the inside of a skull, such as a brain, spinal cord, etc. and the figurine. In this form, the toy may include sets of one-half of robot-skull enclosures that together form various complete, robot heads. In addition, more than two enclosures may be used to make a first toy form. And while the enclosures are shown as being the same size and shape, in other embodiments, the enclosures may be different sizes or different shapes (with respect to one another).

As shown in FIGS. 1A and 1B, the first enclosures 12*a*, 14*a* each have an upper end 16*a*, 18*a*, respectively. The second enclosures 12*b*, 14*b* also each have an upper end 16*b*, 18*b*, respectively. The first enclosures 12*a*, 14*a* each have a lower end 20*a*, 22*a*, respectively, opposing the upper ends 16*a*, 18*a*. Similarly, the second enclosures 12*b*, 14*b* each have a lower end 20*b*, 22*b*, respectively, opposing their upper ends 16*b*, 18*b*. The first enclosures 12*a*, 14*a* each have a front portion or face 24*a*, 26*a* and an opposite rear portion or face (not shown in FIGS. 1A-1C). Similarly, each second enclosure 12*b*, 14*b* has a front portion or face 24*b*, 26*b*, respectively, and an opposing rear portion or face (not shown in FIGS. 1A-1C). Each first enclosure 12*a*, 14*a* provides one-half of a base 28*a*, 30*a*. Each second enclosure 12*b*, 14*b* provides the corresponding one-half of a base 28*b*, 30*b*, respectively. As shown in FIG. 1A, each first enclosure base 28*a*, 30*a* matches up and fits together with its second enclosure base 28*b*, 30*b*, respectively, to form a complete base upon which the toy can stand.

As shown in FIGS. 1A and 1C, to form the first toy form (i.e., the heart), a first enclosure 12*a*, 14*a* is attached to a second enclosure 12*b*, 14*b*. The enclosures are attached such that the upper end 16*a*, 18*a* of a first enclosure 12*a*, 14*a* corresponds to the upper end 16*b*, 18*b* of a second enclosure 12*b*, 14*b*, the lower end 20*a*, 22*a* of a first enclosure 12*a*, 14*a* corresponds to the lower end 20*b*, 22*b* of a second enclosure 12*b*, 14*b*. The front portion 24*a*, 26*a* of a first enclosure 12*a*, 14*b*, respectively, and the front portion 24*b*, 26*b*, respectively, of a second enclosure 12*b*, 14*b* both face the same direction. The front portion 24*a*, 26*a* of the first enclosure 12*a*, 14*a* is substantially in the same plane as the front portion 14*b*, 26*b* of the corresponding second enclosure 12*b*, 14*b*. Similarly, the rear portion of the first enclosure is in substantially the same plane as the rear portion of the second enclosure.

As described in more detail below, FIGS. 1A-1C and 3 show the enclosures 12*a*, 12*b*, 14*a*, 14*b* in their closed position; i.e., their respective front portions are attached or connected to their respective rear portions. For example, in the first set I, front portion 24*a* is connected to rear portion 62, which is shown in more detail in FIG. 3, and described below. As also described in more detail below, in any set, at least one figurine may be substantially concealed within a first enclosure 12*a*, 14*a* and at least one figurine may be substantially concealed with a second enclosure 12*b*, 14*b* when the toy is in the first toy form or the second form.

To form the first toy form shown in FIGS. 1A and 1C, the enclosures, for example, 12*a* and 12*b*, may be attached by virtually any means known in the art including VELCRO, snap fit (i.e., ball and socket snap fit), friction, clip, interference fit (press fit) or the like. In the embodiment shown in FIGS. 1A and 1C, a first enclosure 12*a*, 14*a* and a second enclosure 12*b*, 14*b*, respectively, are attached by an interference fit. Each enclosure 12*a*, 12*b*, 14*a*, 14*b*, has an undulating edge 34*a*, 34*b*, 36*a*, 36*b*, respectively, at its font portion and rear portion that corresponds to the other enclosure's undulating edge. The undulating edges are oppositely configured in that the "peaks" of a first enclosure's undulating edge correspond to the "valleys" of a second enclosure's undulating edge, and vice versa. In other words, the undulating edges of a first enclosure and a second enclosure may be non-superimposible. These peaks and valleys fit together by friction between them and cause the enclosures to fit together like a puzzle. This provides a snug fit but also an atheistically-pleasing first toy form that may be easily separated into a second toy form. The first enclosure and second enclosure may not have undulating edges; for example, the edge may be straight across (or blunt), may be jagged or have other protrusions.

Figure 2:
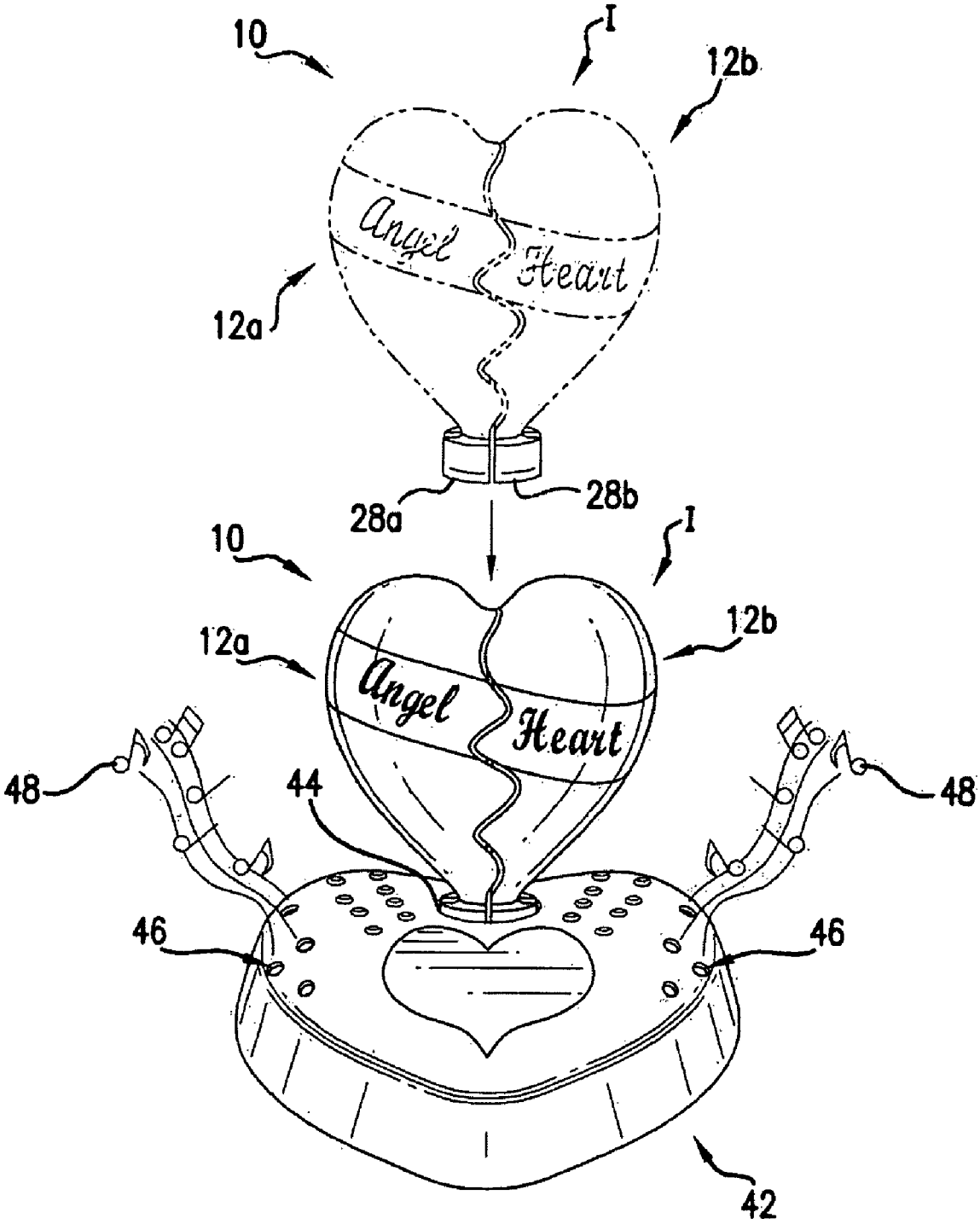
FIG. 2 is a perspective view of one of the toys in FIG. 1A coupled to a docking station.

FIG. 2 shows the toy 10 of the first set I shown in FIG. 1A, in the first toy form, placed upon a docking station 42. While the following discussion is in reference to the first set of FIG. 1A, the following discussion applies to any toy in the first toy form. The docking station 42 includes a slot 44 adapted to accept the joined bases 28*a*, 28*b* of the attached first enclosure 12*a* and second enclosure 12*b*. The slot 44 and toy 10 may include an electrical contact so that the toy 10 and docking station 42 are in electrical communication. Other means may be used for connecting the toy 10 to the docking station 42 such as a cable or a toy may be connected to the docking station remotely. The docking station 42 also has a speaker within (not shown) and a plurality of openings 46 that allow sound 48 from the speaker to be more easily heard. The docking station 42 may also include other sound producing means such as an audio generating circuit having a speech synthesizer, a memory component such as RAM or ROM and an amplifier. The docking station 42 and the toy 10 preferably have a power source, which may be the same or independent for each of the docking station or toy.

The memory component includes a plurality of sounds. These sounds may include, words, phrases, music, sound effects and the like. In addition, the enclosure or the figurines within may include a in memory component such as RAM or ROM. When the toy 10 is connected to docking station 42, either or both of the memory component selects a sound, such as music or words, to be played through the speaker. The sound is transmitted through the circuit. The sound may correspond to the particular toy that is placed upon the docking station. For example, when the toy shown in FIG. 2 is placed on the docking station 42, the speakers may say "Angel Heart," corresponding to the indicia on the toy 10. The docking station 42 may say other phrases unique to the particular combination of first enclosure 12*a* and second enclosure 12*b*. For example, when the heart of FIG. 1C is placed upon the docking station, the docking station may say "Fairy Heart." The docking station 42 may also provide words, phrases, sounds, etc. that are not related to the phrase formed by the toy in the first position. For example, the docking stations 42 may make "predictions" or tell the user's fortune, or say "good luck."

Figure 3:
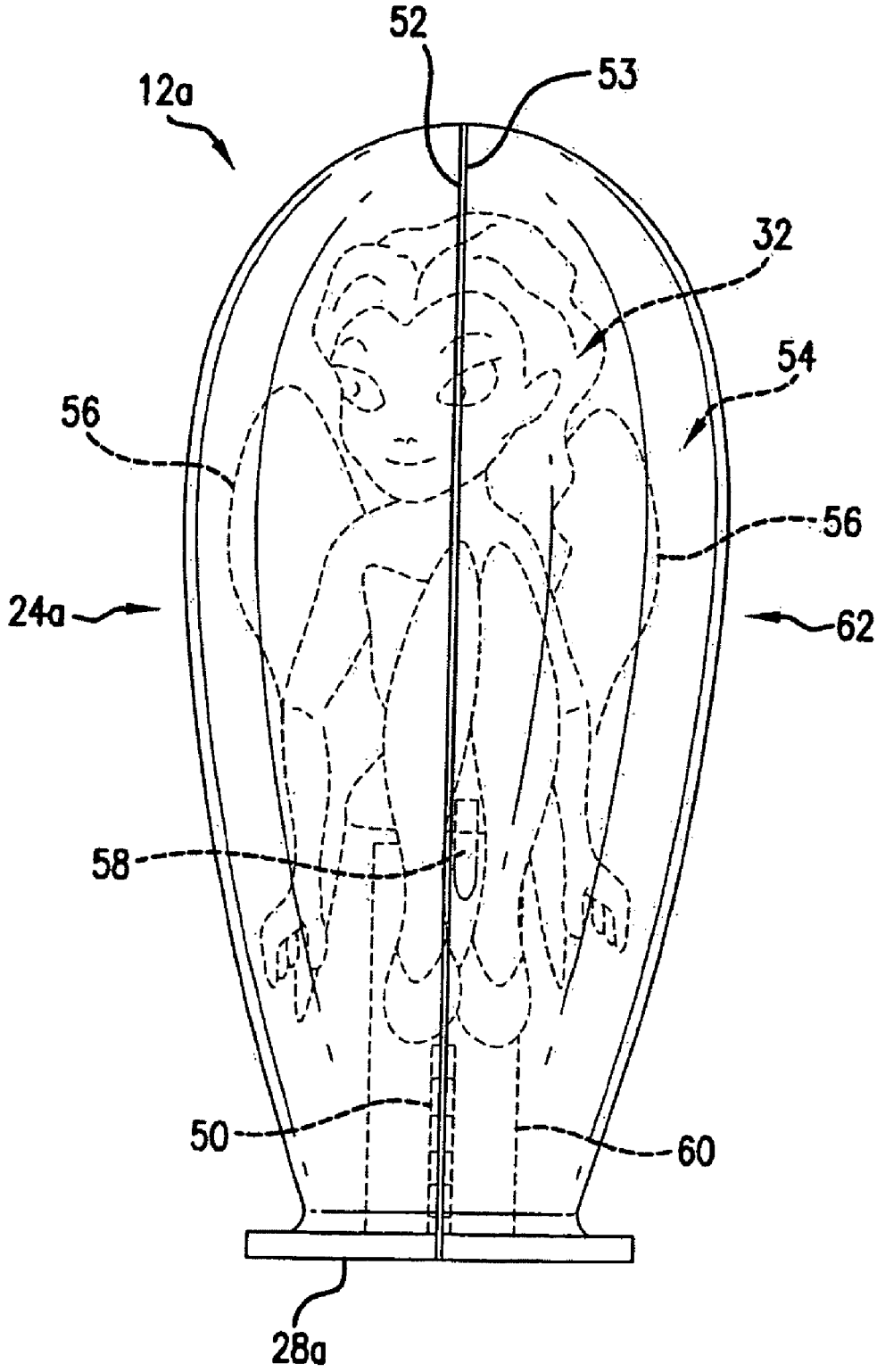
FIG. 3 is a perspective view of a first enclosure of a toy shown in FIG. 1A, in a closed position.

FIG. 3 shows the first enclosure 12*a* of the toy 10 of the first set. However, the following discussion applies to any first enclosure or second enclosure of any set of the toy. The first enclosure 12*a* is defined by a front portion 24*a* and a rear portion 62. The front portion 24*a* and the rear portion 62 are separated by a hinge 50, the runs vertically down the "spine" of the first enclosure. In other words, the hinges 50 separates the first portion 24*a* and second portion 62 of the enclosure, vertically. The hinge 50 may be virtually any hinge known in the art. For example, it may be two attached, parallel hinges, it may be a continuous or piano hinge or a living hinge. The front portion 24*a* and the rear portion 62 are also separated by edges 52, 53 opposite the hinge 50. FIG. 3 shows the first enclosure 12*a* in the closed position. In other words, the front portion 24*a* and the rear portion 62 are attached such that their edges 52, 53 are adjacent one another.

FIG. 3 also shows that the first enclosure 12*a* contains a figurine 32, which is described in more detail below. The figurine 32 has wings 56, which may or may not at least partially further conceal the figurine 32 when in the enclosure 12*a*. The figurine 32 is attached to an interior 54 of the first enclosure 12*a* by a peg 58. However, in other forms, the figurine may be loose within the cavity or interior space and, therefore, completely removable therefrom. The figurine 32 is on a stand 60 and is folded up so that it fits within the first enclosure 12*a*. The figurine 32 is folded at joints (not shown) in at least the hips and knees.

Figure 4:
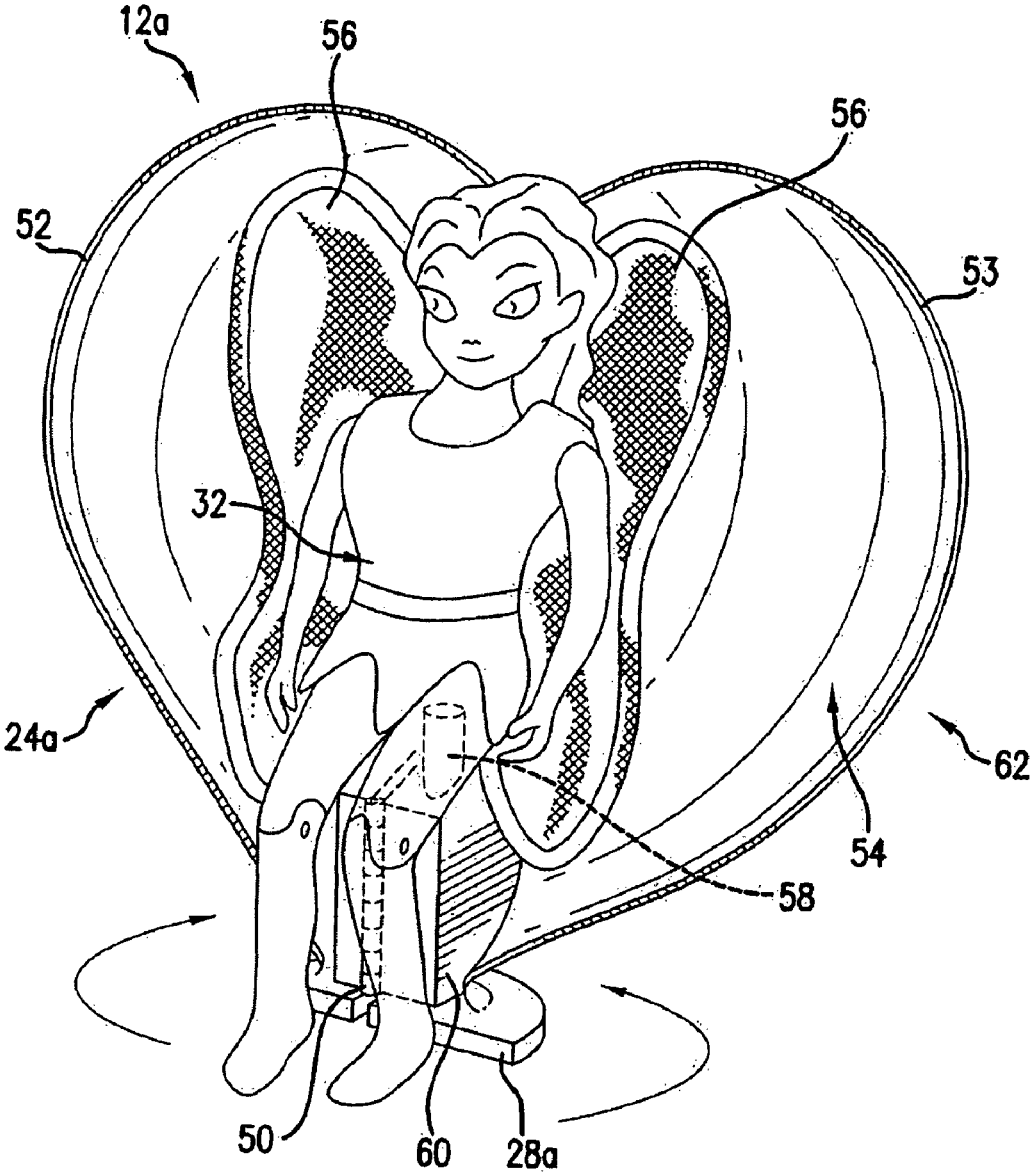
FIG. 4 is a perspective view of the enclosure of FIG. 3 in an open position.

FIG. 4 also shows the first enclosure 12*a* of the toy of the first set. However, the following discussion applies to any first enclosure or second enclosure of any set of the toy. FIG. 4 shows the first enclosure 12*a* in the open position. In the open position, the front portion 24*a* and rear portion 62 are detached or separated. Where the front 24*a* and rear 62 portions are attached by the hinge 50, "detached" means that they are swung apart from each other or opened along the hinge 50. The front portion 24*a* and the rear portion 62 may be attached via other means. For example, the front portion 24*a* and the rear portion 62 may be completely separable. Nevertheless, "detached" or "separated" with respect to a first or second enclosure generally means any position of the front and rear portions that exposes the interior of the enclosure, as described below.

The front portion 24*a* and the rear portion 62 of the first enclosure 12*a* are swung open at the hinge 50. This reveals an interior cavity 54 of the first enclosure 12*a* housing the figurine 32. The figurine 32 is an action figure. By action figure, it is meant that the figurine 32 has moveable and poseable limbs, head and the like. The figurine 32 may have at least jointed knees, hips, shoulders, head, elbows and wings. As shown in FIG. 4, the figurine 32 is an angel with a poseable body and moveable wings 56. The figurine is not limited to an angel. It may be a robot or an animal. In addition, the cavity may not house a figurine. It may house a charm, jewelry or the like. The cavity 54 may also housed messages, indicia, words, phrases, etc. The wings 56 may function as an inner enclosure further concealing the figurine 32 when it is in the enclosure 12*a*. Such an inner enclosure may not be wings, for example, it may be a flower pedal or a sea shell. The enclosure may not include a figurine in the cavity or an inner enclosure whereupon it may be used to store items. As shown in FIG. 3, and provided above, the wings 56 do not conceal the figurine 32 when in the enclosure 12*a*.

As provided above and shown in FIG. 3, the figurine 32 is capable of folding to fit within the enclosure 12*a*. The figurine 32 should be small enough or foldable so that it fits substantially, completely within the interior cavity 54 when the front portion 24*a* and rear portion 62 are attached (i.e., they are swung closed by the hinge.) As shown in FIGS. 3 and 4, the figurine 32 is attached to the enclosure 12*a*. In particular, the figurine 32 is attached to the interior cavity 54 of the enclosure 12*a* via a post or peg 58 attached to the figurine's torso or back by friction. The peg 58 is attached to the at least one hinge 50 of the enclosure. Thus, as the enclosure 12*a* is opened; i.e., as the front portion 24*a* and rear portion 62 are separated, the figurine 32 moves, substantially contemporaneously with the opening of the enclosure 12*a*, out of the interior cavity 54. The figurine 32 may also unfold as it moves out of the interior cavity 54. In other words, any joints that were bent while in the enclosure, such as the hip joints, unbend, in effect, unfolding the figurine. Further, as the figurine 32 moves out of the interior cavity 54, the wings 56 (or inner enclosure) may substantially, further contemporaneously open.

FIG. 4 shows the figurine 32 substantially out (or protruding from) the interior cavity 54 of the enclosure 12*a* with its wings 56 open. The figurine 32 may rest upon the stand 60, which rests upon the base 28*a*. The moveable and possible limbs, head, torso, etc. allow the figure to be played with or manipulated. As the front portion 24*a* and rear portion 62 of the enclosure 12*a* are closed or reattached, the figurine 32 moves, substantially contemporaneously with the closing of the enclosure 12*a*, back into the interior cavity 54 of the enclosure and, thus, assumes the position shown in FIG. 3. The figurine may automatically bend at a joint to fold back into the enclosure cavity. The wings also may substantially contemporaneously close as the front portion and rear portion close.

As provided above, the front portion 24*a* and the rear portion 62 may have indicia. In particular, the front portion 24*a* may have the word "Angel," as shown in FIG. 1A. The rear portion may have the word "Love" or another word that forms an intelligible phrase with the indicia or word on the front portion 24*a*. Thus, when the first enclosure 12*a* (or any other enclosure) is in the open position, as shown in FIG. 4, the front portion 24*a* and the rear portion 62 form a new phrase on the reverse side of the figurine. In the example provided above, this phrase is "Angel Love."

A variety of modifications to the toys described will be apparent to those skilled in the art from the disclosure provided herein. Thus, these toys may be embodied in other specific forms without departing from the spirit or essential attributes thereof and, accordingly, reference should be made to the appended claims, rather than to the foregoing specification, as indicating the scope.

What is claimed is:

1. A toy comprising:

at least two enclosures that attach to each other to form a first toy form and, when separate from each other, forming second and third toy forms, wherein each enclosure comprises at least two enclosure portions that attach to and separate from each other, and at least one removable representational object in at least one of the enclosures, and wherein each of the enclosure portions complements the other enclosure portion of the same enclosure in the second and third toy forms and an adjacent enclosure portion of another enclosure in the first toy form; and wherein the two enclosure portions are attached by a hinge.

2. The toy of claim 1, wherein the figurine is substantially concealed when in the first toy form.

3. The toy of claim 1, wherein the figurine is substantially concealed when the toy is in the second toy form and the enclosure portions are attached to each other.

4. The toy of claim 1, wherein the figurine is substantially exposed when in the second toy form and when the enclosure portions are separated from each other.

5. The toy of claim 1, adapted such that the two enclosure portions must be attached to each other when the toy is in the first toy form.

6. The toy of claim 1, wherein the enclosures are completely separable from each other.

7. The toy of claim 1, wherein the enclosures define a substantially hollow cavity when in the first toy form that houses the figurine.

8. The toy of claim 1, wherein the two enclosures are each one-half of a heart and wherein the enclosures form a heart when attached.

9. The toy of claim 7, wherein the figurine is adapted to substantially, contemporaneously move out of the cavity as the two enclosure portions are separated from each other and substantially, contemporaneously move back into the cavity as the two enclosure portions are reattached to each other.

10. The toy of claim 1, wherein the figurine is coupled to the hinge.

11. The toy of claim 9, wherein the figurine is hinged and is folded when the enclosure portions are attached and wherein the figurine is adapted to substantially, contemporaneously unfold as the enclosure portions are separated from each other and substantially, contemporaneously fold as the enclosure portions are reattached to each other.

12. A toy comprising:

a plurality of first enclosures, each first enclosure comprising first and second enclosure portions that attach to and separate from each other;

a plurality of second enclosures, each second enclosure comprising first and second enclosure portions that attach to and separate from each other; and at least one removable representational object substantially within an interior space of the first enclosures and at least one figurine substantially within an interior space of the second enclosures, wherein the first enclosures are adapted to attach only to the second enclosures when the first enclosure portion of the first enclosures faces substantially the same direction as the first enclosure portion of the second enclosures and the second enclosures are adapted to attach only to the first enclosures when the first enclosure portion of the second enclosures faces substantially the same direction as the first enclosure portion of the first enclosures, wherein when a first enclosure and a second enclosure are attached, they form a first toy form and when the first enclosure and the second enclosure detach, they form second and third toy forms, and wherein each of the enclosure portions complements the other enclosure portion of the same enclosure in the second and third toy forms and an adjacent enclosure portion of another enclosure in the first toy form; and wherein the enclosure portions of the first enclosures and the second enclosures are attached by a hinge and the figurine is coupled to the hinge.

13. The toy of claim 12, wherein the first enclosures are adapted to attach other first enclosures only when the front enclosure portion of one first enclosure faces the opposite direction as the front enclosure portion of a second first enclosure.

14. The toy of claim 12, wherein the first enclosures and the second enclosures each comprise indicia, and wherein at least one first enclosure has identical indicia to at least one second enclosure, thereby forming a set of enclosures.

15. The toy of claim 14, wherein a first enclosure and a second enclosure in a set have different but complementary indicia.

16. The toy of claim 15, wherein the different but complementary indicia are words and wherein the identical indicia is a pattern.

* * * * *